US007706734B2

(12) United States Patent
Higashimura et al.

(10) Patent No.: US 7,706,734 B2
(45) Date of Patent: Apr. 27, 2010

(54) IMAGE FORMATION APPARATUS INCLUDING GUIDE MEMBER FOR TRANSFER SHEET

(75) Inventors: Hideji Higashimura, Toyokawa (JP); Yusuke Ukai, Toyokawa (JP); Katsumi Shirai, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 66 days.

(21) Appl. No.: 11/987,386

(22) Filed: Nov. 29, 2007

(65) Prior Publication Data

US 2008/0122168 A1 May 29, 2008

(30) Foreign Application Priority Data

Nov. 29, 2006 (JP) ..... 2006-322531

(51) Int. Cl.
*G03G 15/16* (2006.01)

(52) U.S. Cl. ..... 399/316; 399/388

(58) Field of Classification Search ..... 399/316, 399/388, 302, 308
See application file for complete search history.

(56) References Cited

U.S. PATENT DOCUMENTS 5,386,274 A 1/1995 Sanpe et al.
5,594,539 A * 1/1997 Murano et al. ..... 399/316
2009/0010675 A1* 1/2009 Suzuki ..... 399/308 X

FOREIGN PATENT DOCUMENTS

| | | |
|---|---|---|
| JP | 64-081734 | 3/1989 |
| JP | 02-058266 U | 4/1990 |
| JP | 06-208306 | 7/1994 |
| JP | 10-254253 | 9/1998 |
| JP | 11-065179 | 3/1999 |
| JP | 2006-011044 | 1/2006 |
| JP | 2006-139168 A * | 6/2006 |

OTHER PUBLICATIONS

Machine translation of JP 2006-011044 A dated Jun. 1, 2009.*
Notification of Reasons for Refusal in JP 2006-322531 dated Dec. 24, 2008, and an English Translation thereof.

* cited by examiner

*Primary Examiner*—Sophia S Chen
(74) *Attorney, Agent, or Firm*—Buchanan Ingersoll & Rooney PC

(57) ABSTRACT

In an image forming apparatus, a toner image formed on an intermediate transfer belt is transferred to a transfer sheet by a transfer electric field generated between a secondary transfer roller and a driving roller. A guide surface of a pre-transfer guide and a flat portion of the intermediate transfer belt form an angle of no less than 13° and no greater than 17°, and a distance from a tip of the guide surface and the flat portion is no less than 1.0 mm and no greater than 3.0 mm.

3 Claims, 9 Drawing Sheets

FIG. 3

PROCESS SPEED 310mm/s

| θ [°] | DISTANCE A BETWEEN BELT SURFACE AND TIP POSITION [mm] | | | | | | | | | | |
|---|---|---|---|---|---|---|---|---|---|---|---|
| | 0 | 0.5 | 1 | 1.5 | 2 | 2.5 | 3 | 3.5 | 4 | 4.5 | 5 |
| 10 | | | × | | × | | × | | × | | × |
| 11 | | | | | | | | | | | |
| 12 | | | △ | | △ | | × | | × | | × |
| 13 | | | ○ | ○ | | ○ | ○ | △ | | | × |
| 14 | | | | | | | | | | | |
| 15 | | | ○ | | ○ | ○ | ○ | △、× | △ | | × |
| 16 | | | | | | | | | | | |
| 17 | | | ○ | | ○ | ○ | ○ | △ | ○、× | × | |
| 18 | | | △ | | △ | | △ | | × | | × |
| 19 | | | | | | | | | | | |
| 23 | | | × | | × | | × | | × | | × |

FIG. 6

PROCESS SPEED 60mm/s

| θ [°] | DISTANCE A BETWEEN BELT SURFACE AND TIP POSITION [mm] | | | | | | | | | |
|---|---|---|---|---|---|---|---|---|---|---|
| | 0 | 0.5 | 1 | 1.5 | 2 | 2.5 | 3 | 3.5 | 4 | 4.5 | 5 |
| 10 | | | △ | | × | | × | | × | | × |
| 11 | | | | | | | | | | | |
| 12 | | | ○ | | ○ | | ○ | | × | | × |
| 13 | | | ○ | ○ | | ○ | ○ | ○ | | | × |
| 14 | | | | | | | | | | | |
| 15 | | | ○ | | ○ | ○ | ○ | ○ | ○ | | × |
| 16 | | | | | | | | | | | |
| 17 | | | ○ | | ○ | ○ | ○ | ○ | ○ | △ | |
| 18 | | | ○ | | ○ | | ○ | | △ | | △ |
| 19 | | | | | | | | | | | |
| 23 | | | △ | | △ | | △ | | × | | × |

IMAGE FORMATION APPARATUS INCLUDING GUIDE MEMBER FOR TRANSFER SHEET

This application is based on application No. 2006-322531 filed in Japan, the content of which is hereby incorporated by reference.

BACKGROUND OF THE INVENTION (1) Field of the Invention

The present invention relates to a image forming apparatus that forms an image by transferring a toner image from an image holding belt such as an intermediate transfer belt, to a transfer sheet.

(2) Description of the Related Art

Color image forming apparatuses that are capable of copying and/or printing full color images using electronic photographing methods have come into practical use in recent years. One technique used to transfer an image to a transfer sheet in a color image forming apparatus is an intermediate transfer method. With an intermediate transfer method, yellow (Y), magenta (M), cyan (C) and black (B) images that have been formed separately on a photosensitive body are superimposed on each other in turn on an intermediate transfer belt in accordance with reference marks on the intermediate transfer belt, and then the entire resultant full color toner image is transferred from the intermediate transfer belt to a transfer sheet by a transfer roller (secondary transfer).

Since transfer to the transfer sheet only needs to be performed once, an image forming apparatus that uses this kind of intermediate transfer method has the advantage of obtaining stable image quality and an ability to deal with various types of paper compared to an image forming apparatus that must perform a plurality of transfers to a transfer sheet directly.

However, in an image forming apparatus that uses an intermediate transfer method, if the transfer sheet and the intermediate transfer belt do not contact each other closely at a place just before the transfer sheet enters a transfer nip formed between the transfer roller and the transfer belt, and hence a small gap exists therebetween, the transfer sheet may touch the transfer roller directly at the place before the transfer nip. This will cause the toner to spatter due to the electric field generated between the transfer sheet and the intermediate transfer belt, resulting in problems such as poor image quality, and also cause discharge to occur in parts, resulting in pin holes in the image.

Various attempts have been made to avoid such problems, one of which is the technique disclosed in Japanese Unexamined Patent Application Publication No. H05-197241. This technique stipulates a range of 0° to 40° for an angle between the surface of the intermediate transfer belt and a guide surface of a pre-transfer guide that guides the transfer sheet to the transfer nip, ensuring that the transfer sheet is more likely to be in close contact with the intermediate transfer belt before the transfer nip.

However, the inventors of the present invention discovered that simply ensuring that the angle between the guide surface of the pre-transfer guide and the intermediate transfer belt is in a range of 0° to 40° is not sufficient to maintain contact between the intermediate transfer belt and the transfer sheet stably before the transfer nip, or to prevent poorness of transfer.

Such poorness transfer occurs when transferring the toner image from the substantially belt-shaped image holding body (image holding belt) to the transfer sheet, and therefore are not unique to color image forming apparatuses, but also occur in monochrome image forming apparatuses that use an image holding belt. These problems can also occur when the image holding belt is a photosensitive belt, and a toner image is formed by direct exposure scanning of the belt and transferred to a transfer sheet.

SUMMARY OF THE INVENTION

The present invention was conceived in view of the above situation, and has an object of providing an image forming apparatus that produces a favorable transfer image by advancing a transfer sheet into a transfer nip in a state that ensures stability of close contact between the transfer sheet and an image holding belt such as an intermediate transfer belt.

In order to achieve the stated object, the present invention is an image forming apparatus, including: an image holding belt which is suspended about a plurality of rollers including a first roller and a second roller, and circulates in a predetermined direction; an image forming unit operable to form a toner image on a surface of the image holding belt; a transfer roller that contacts a portion of the circulating image holding belt, which is supported by the first roller, thereby forming a transfer nip, a transfer electric field being generated between the transfer roller and the first roller, and the toner image being transferred from the surface of the image holding belt to a transfer sheet that passes through the transfer nip; and a first guide member operable to guide the transfer sheet to a flat portion of the circulating image holding belt surface, the flat portion being located upstream from the transfer nip in a circulation direction of the image holding belt and between the first and second rollers, wherein an angle formed by a guide surface of the first guide member and a surface of the flat portion of the image holding belt is no less than 13° and no greater than 17°, and a distance between a closest edge of the guide surface to the image holding belt and the surface of the image holding belt is no less than 1.0 mm and no greater than 3.0 mm.

Here, the image holding belt may, for instance, be an intermediate transfer belt to which a toner image formed on a photosensitive body is primary transferred, or a photosensitive belt that itself has a photosensitive body function and the toner image is directly formed on the belt by a developer.

Furthermore, the recitation "a plurality of rollers including a first roller and a second roller" may also be interpreted as including a case in which the plurality of rollers consists of only the first roller and the second roller.

According to the stated structure, the contactability between the transfer sheet and the image holding belt directly before the transfer nip can be stabilized, and a favorable transfer image without toner spattering and pin holes can be obtained.

Here, it preferable that a distance from (a) a central position of the transfer nip in the circulation direction of the image holding belt to (b) the closest edge of the guide surface to the image holding belt is no less than 13.3 mm and no greater than 18.5 mm.

According to the stated structure, the contactability between the transfer sheet and the image holding belt just before the transfer nip can be further stabilized, and a favorable transfer image can be obtained.

Here, it preferable that the image forming apparatus further includes: a first forcing mechanism operable to force the first guide member toward the image holding belt; and a first regulating member that contacts the first guide member, and is operable to regulate a distance from the first guide member to the surface of the image holding belt.

According to the stated structure, the first guide member can be easily positioned when assembling the image forming apparatus, and the risk of the positional relationship between the first guide member and the image holding belt changing due to aging is eliminated.

Here, the image forming apparatus may further include: a second guide member positioned so as to oppose the first guide member, the transfer sheet passing between the first guide member and the second guide member; a second forcing mechanism operable to force the second guide member toward the first guide member; and a second regulating member operable to regulate a distance between opposing surfaces of the first guide member and the second guide member.

According to the stated structure, the first guide member and the second guide member can be easily positioned relative to each-other during assembly, and the risk of the positional relationship between the first guide member and the second guide member changing due to aging is eliminated.

Here, it is preferable that the second regulating member regulates the distance between the opposing surfaces of the first guide member and the second guide member as to be no less than 0.7 mm and no greater than 1.0 mm at a location closest to the transfer nip.

According to the stated structure, even if the transfer sheet curls, the transfer sheet can be sent to the surface of the image holding belt along the guide direction of the first guide member, and therefore a favorable transfer image can be obtained.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings:

FIG. 3 is a table showing results of evaluation tests when a processing speed is 310 mm/s;

FIG. 6 is a table showing results of evaluation tests when the processing speed is 60 mm/s;

DESCRIPTION OF THE PREFERRED EMBODIMENTS

The following describes a preferred embodiment of an image forming apparatus of the present invention, using an example of a tandem full color image forming apparatus (hereinafter simply referred to as a printer).

Structure of Printer 1

Figure 1:
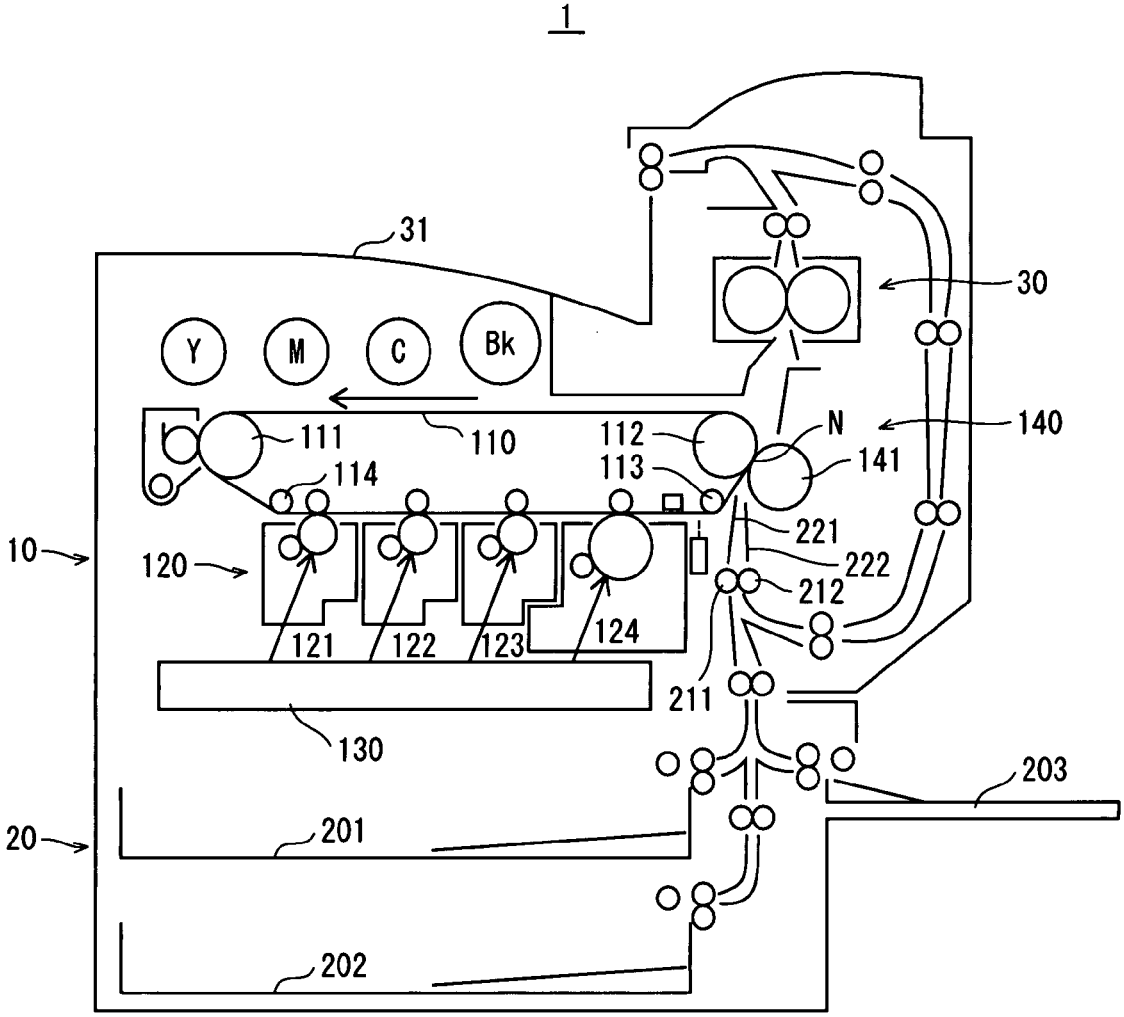
FIG. 1 is a schematic view of the overall structure of a printer of a preferred embodiment of the present invention.

FIG. 1 is a schematic view of the overall structure of a printer 1.

The printer 1 is principally composed of an image forming part 10, a paper feeding part 20, and a fixing part 30.

In the image forming part 10, an intermediate transfer belt 110 is suspended by a driving roller 112, a driven roller 111 and auxiliary rollers 113 and 114. These are driven by driving devices (not illustrated) so as to rotate in the direction shown by the arrow in FIG. 1. Four image creating units 121 to 124, which constitute a image creating part 120, are provided in a below the intermediate transfer belt 110, adjacent to each other in the direction of travel of the intermediate transfer belt 110. Yellow, magenta, cyan and black (Y, M, C, BK) toner images formed by each of the image creating units 121 to 124 are transferred to the intermediate transfer belt 110 superimposed in turn (primary transfer).

Here, the image creating units 121 to 124 are known technology, each being composed of a photosensitive drum, a charger, a developer, a cleaning plate and the like. On a surface of the photosensitive drum of each of the image creating units 121 to 124, a static latent image of the corresponding development color is formed by scanning of the exposing apparatus 130, and then developed to form a toner image of the color. A corresponding primary transfer roller has each of the toner images transferred to the intermediate transfer belt 110 by static electric power so as to be superimposed in turn.

The paper feeding part 20 includes paper feeding cassettes 201 and 202 and a manual paper feed tray 203. Transfer sheets are fed one sheet at a time from one of these by corresponding set of pickup rollers, and carried upward to the secondary transfer part 140 by carrier rollers.

The superimposed toner image on the intermediate transfer belt 110 receives a predetermined transfer electric field in a transfer nip N that is the place at which the driving roller 112 and the portion of the intermediate transfer belt 110 supported by the driving roller 112 contact each other, and is secondary transferred to a transfer sheet that has been carried from the paper feeding part 20 with appropriate timing. This is then heat fixed by the fixing apparatus 30, and discharged onto a discharge tray 31.

A pair of pre-transfer guides 221 and 222 are provided upstream of the secondary transfer part 140 in the direction in which the transfer sheet is carried (hereinafter this "upstream" is also referred to as the "front"). This arrangement is particularly designed such that close contact between the intermediate transfer belt and the transfer sheet is favorably maintained before the transfer nip N due to the action of the pre-transfer guide 221.

Structure of Pre-transfer Guides

Figure 2:
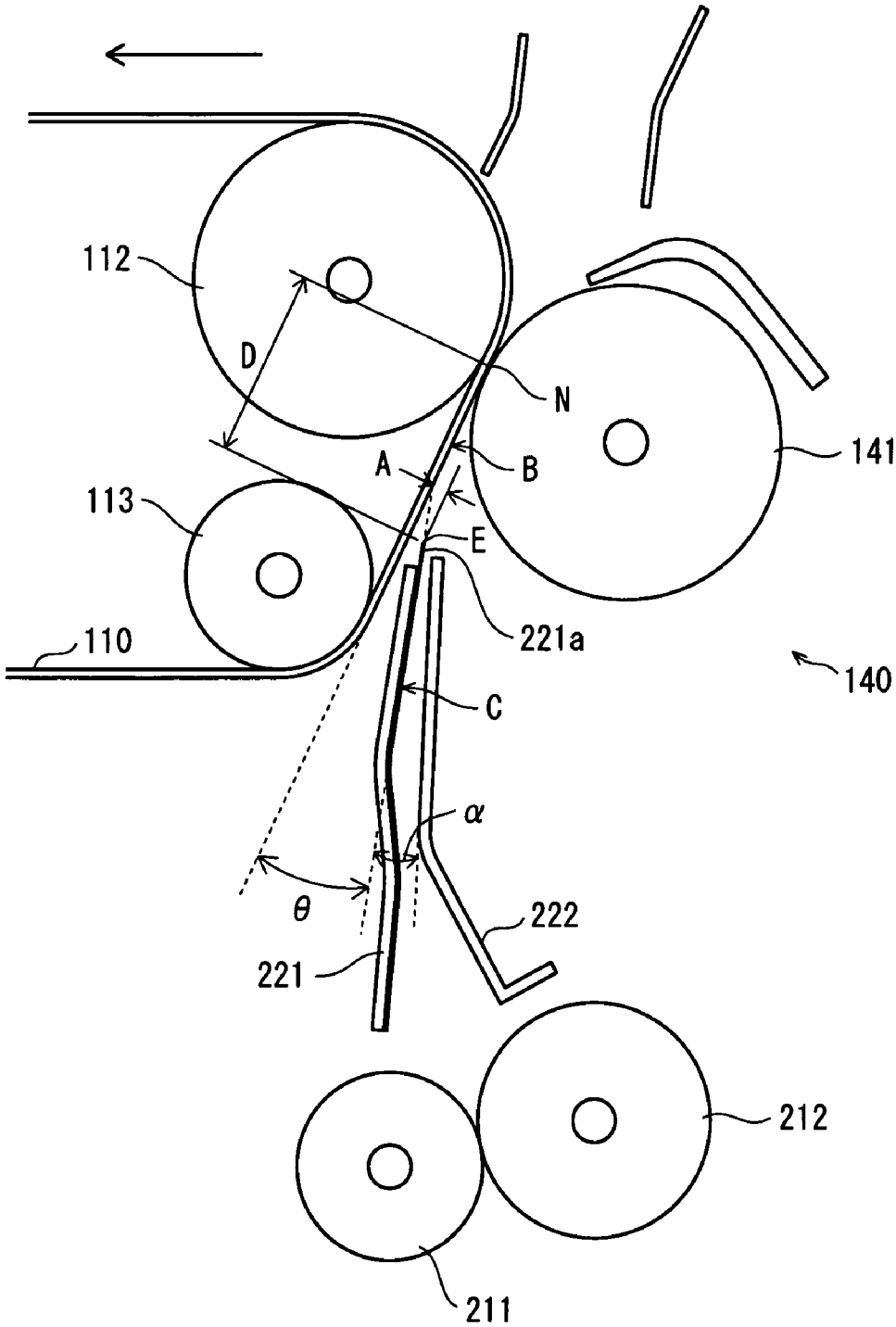
FIG. 2 shows a secondary transfer part and pre-transfer guides in the printer.

FIG. 2 shows an exploded view of the secondary transfer part 140 and the pre-transfer guides 221 and 222 in the present embodiment.

As shown in FIG. 2, the transfer nip N is formed at the contacting portion of the secondary transfer roller 141 and the portion of the intermediate transfer belt 110 supported by the driving roller 112. In the present embodiment, the diameter and interaxial distance of the driving roller 112 and the secondary transfer roller 141 are set such that the nip width of the transfer nip N (i.e., the length of the contacting portion of the intermediate transfer belt 110 and the secondary transfer roller 141 in the traveling direction) is 4.5 mm.

The auxiliary roller 113 is structured such that the portion of the intermediate belt 110 in front of the transfer nip is flat due to the intermediate transfer belt 110 being suspended by the auxiliary roller 113 and the driving roller 112 (hereinafter, referred to as the belt flat portion B).

The pre-transfer guides 221 and 222 are for guiding a transfer sheet carried by a pair of timing rollers 211 and 212 to the belt flat portion B of the intermediate transfer belt 110. In the present example, the tangent plane at a nip of the timing rollers 211 and 212 is slightly inclined toward the pre-transfer guide 221 so that the transfer sheet advances along the guide surface of the pre-transfer guide 221.

Each of the pre-transfer guides 221 and 222 is a plate-shaped member made of a metal material such as stainless steel. In particular, a resin film is attached to the guide surface-side of the pre-transfer guide with adhesive or the like. The resin film is a PET film or the like having a thickness of approximately 0.1 mm to 0.2 mm. The tip part of the resin film protrudes approximately 1 mm to 2 mm from the edge of the metal plate toward the intermediate transfer belt 110. This enables the tip part of the guide surface to be as close as possible to the surface of the intermediate transfer belt 110.

A PET film may also be attached to the inner surface of the pre-transfer guide 222. This is because a resin film has the advantage of staying relatively clean as toner does not easily attach thereto.

Hereinafter, the guide surface of the pre-transfer guide 221 is used to refer to a surface C which is the surface of the resin film 221*a* and is the flat portion of the resin film 221 closer to the intermediate transfer belt. (This is essentially the part that determines the direction in which the transfer sheet is sent to the intermediate belt 110.) Furthermore, the tip part of the guide surface of the pre-transfer guide 221 is used to refer to an edge part E of the side of the resin film 221*a* closer to the transfer nip N.

Here, θ denotes the angle between the flat portion B of the intermediate transfer belt 110 and the guide surface C of the pre-transfer guide 221 (called an entry angle), and A denotes the shortest distance between the tip part E of the pre-transfer guide 221 and the surface of the belt flat portion B of the intermediate transfer belt 110. It is preferable that θ and A are set in range where $13° \leqq \theta \leqq 17°$ and $1\ \text{mm} \leqq A \leqq 3\ \text{mm}$.

The reasons for this are as follows.

FIG. 3 is a table showing the quality of transfer in a test model printer in which the entry angle θ was varied from 10° through to 23° by units of 1°, and the value of A was varied in units of 0.5 mm from 1.0 mm through to 5.0 mm with respect to each value of θ.

Evaluation tests were carried out in the following manner. First, a camera was installed in the test model printer for taking magnified video of the portion directly before the transfer nip N of the intermediate transfer belt 110. The camera was made to record while a transfer sheets was fed under the same conditions as for actual image forming. The recorded video was played back one frame at a time to measure the width, in the transfer sheet carrying direction, of the portion of the intermediate transfer belt and the transfer sheet that contact each other directly before the transfer nip N (hereinafter, referred to as a contacting width). A record was made of each measured contacting width.

Arrangements whereby the contacting width from when the front end of the transfer sheet entered the intermediate transfer belt until the back end of the transfer sheet came out of the transfer nip N was stable at 2.6 mm or greater were evaluated as good (denoted by a circle "○"). Arrangements whereby the contacting width fluctuated drastically where evaluated as poor (denoted by a cross "X"), and arrangements whereby the contacting width was stable but less than 2.6 mm were evaluated as fair (denoted by a triangle "Δ")

As can be seen from the table, arrangements where $13° \leqq \theta \leqq 17°$ and $1\ \text{mm} \leqq A \leqq 3\ \text{mm}$ were those for which a good evaluation was given, proving that a favorable transfer image can be obtained in this range.

Note that other conditions for the evaluation test were as follows.

(i) process speed (rotation speed of the intermediate transfer belt): 310 mm/s (ii) thickness of transfer sheet: sheet basis weight 80 $g/m^2$ (iii) no curl in transfer sheet (iv) secondary transfer voltage: 1500V (v) secondary transfer roller diameter: 29.6 mm (vi) distance D between (a) central part of the transfer nip in the circulation direction of the intermediate transfer belt 110 (the part where a plane passing through the axis of driving roller 112 and secondary transfer roller 141 intersects the transfer nip) and (b) the guide surface tip: 15.5 mm FIGS. 4A and 4B and FIGS. 5A and 5B are graphs showing examples of the measurement results.

In each graph the horizontal axis represents the time (in seconds) from when the front edge of the transfer sheet passed through the timing rollers though to when the back edge of the transfer sheet came out of the transfer nip N, and the vertical represents the contacting width (in mm) of the intermediate transfer belt 110 and the transfer sheet directly before the transfer nip.

Figure 4A:
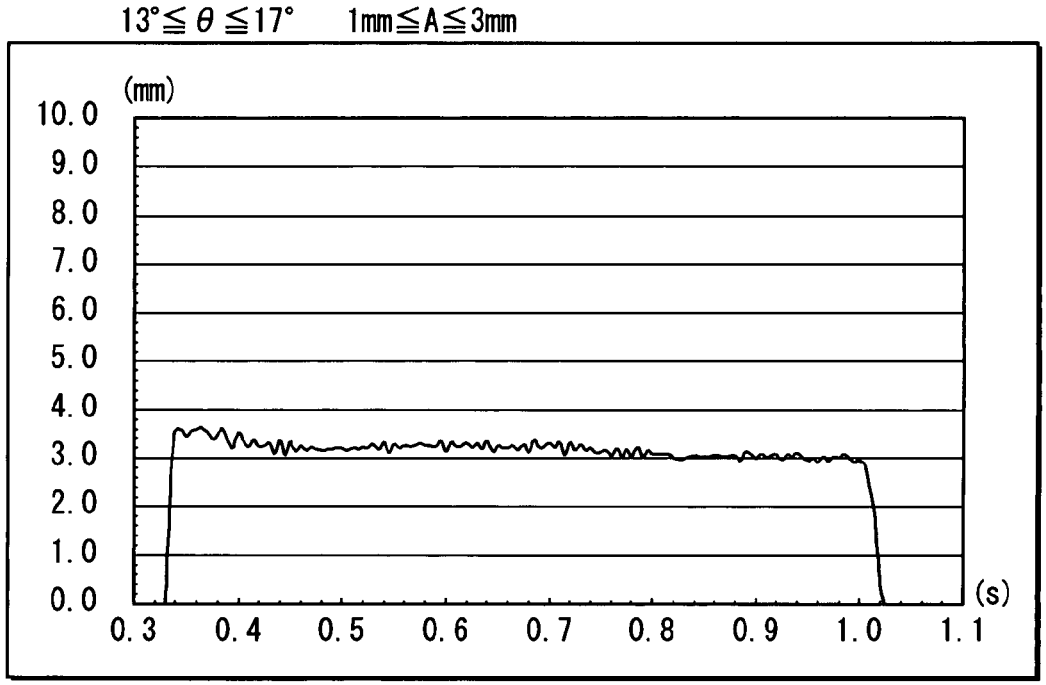
FIG. 4A is a graph showing fluctuations in the contacting width of a transfer sheet and an intermediate transfer belt in a range of $13° \leqq \theta \leqq 17°$ and $1\ \text{mm} \leqq A \leqq 3\ \text{mm}$.

Firstly, FIG. 4A is a graph showing fluctuations in the contacting width in the range of $13° \leqq \theta \leqq 17°$ and $1\ \text{mm} \leqq A \leqq 3\ \text{mm}$.

As shown in FIG. 4A, under these conditions, while slight fluctuations in the contacting width exist, the contacting width is substantially stable at 3 mm to 4 mm while the transfer sheet passes through the transfer nip N. This degree of fluctuation is sufficiently low that a favorable image was obtained, with a visual inspection revealing no effect on the actual transfer image.

Figure 4B:
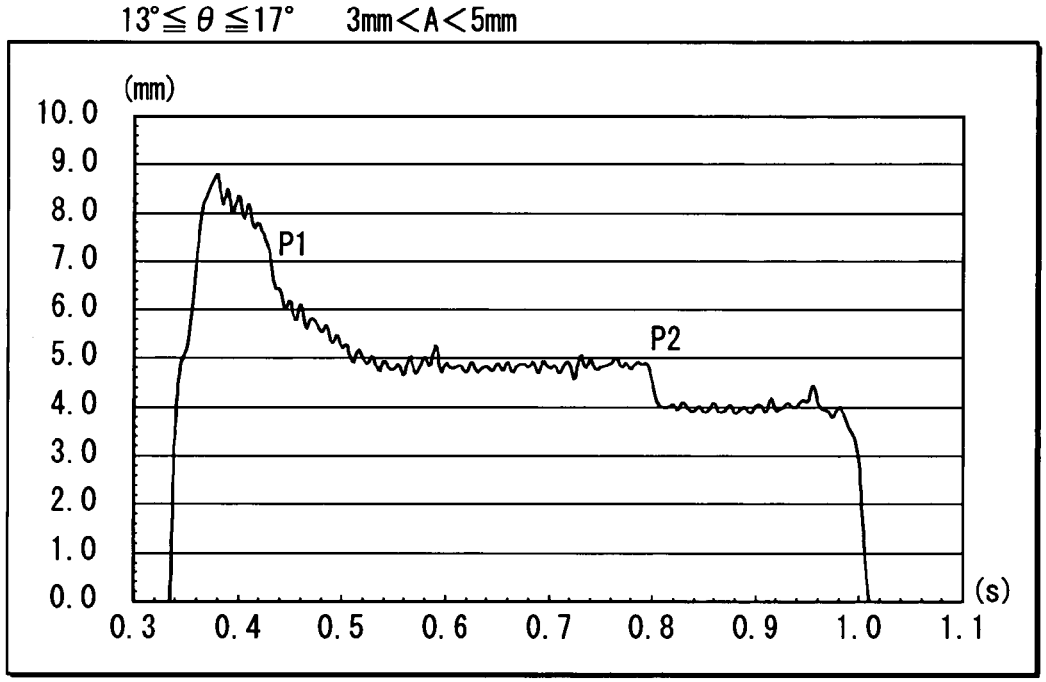
FIG. 4B is a graph showing fluctuations in the contacting width of the transfer sheet and the intermediate transfer belt in a range of $13° \leqq \theta \leqq 17°$ and $3\ \text{mm} < A < 5\ \text{mm}$.

FIG. 4B is a graph showing fluctuations in the contacting width in the range of $13° \leqq \theta \leqq 17°$ and $3\ \text{mm} < A < 5\ \text{mm}$.

As shown in FIG. 4B, under these conditions, the contacting width changes drastically at P1 and P2 while the transfer sheet passes through the transfer nip N. It is thought that in this case, the fact that A has a relatively high value causes the transfer sheet to bend greatly immediately after the front end of the transfer sheet hits the intermediate transfer belt 110 or the direct transfer nip N, thus causing a relatively large contacting width of 9 mm, and then the contacting width is dramatically reduced at P1 due to the stiffness of the transfer sheet. Furthermore, P2 is the point at which that back end of the transfer sheet comes out of a pair of timing rollers. It is thought that the impact when the transfer sheet comes out of the pair of timing roller affects the contacting width, further decreasing in the contacting width.

In other words, it is thought that when A exceeds 3 mm, the free end of the transfer sheet ahead of the guide surface is relatively long, and this part of the transfer sheet swings, thus causing dramatic decreases in the contacting width such as at P1 and P2 as described above. The contacting width dramatically decreases, as if the transfer sheet would be pulled away from the intermediate transfer belt 110. Electrical discharge and spattering of toner occur in places in the small gap when the transfer sheet is pulled away, causing degradation in the transfer image.

In fact, a visual inspection of the transfer image found remarkable degradation in the image in the portion corresponding to P1. In contrast, almost no degradation of the image was evident at the position corresponding to P2. As such, in the present test an evaluation of poor was given only when a sharp decrease exceeding 1 mm was found in the contacting width.

Figure 5A:
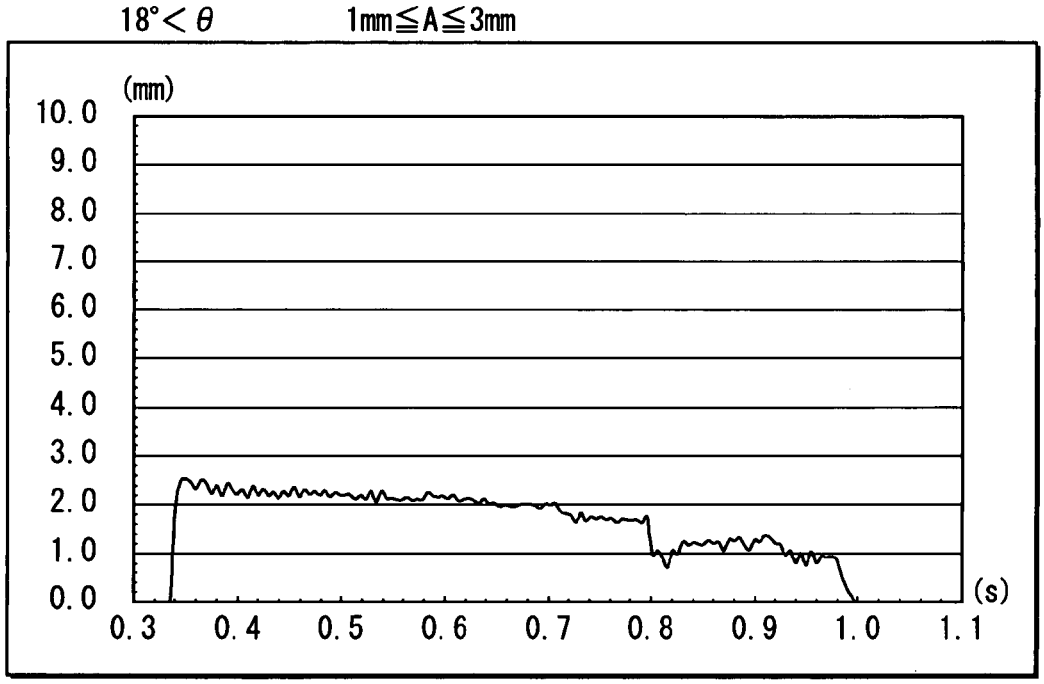
FIG. 5A is a graph showing fluctuations in the contacting width of the transfer sheet and the intermediate transfer belt in a range of $18° < \theta°$ and $1\ \text{mm} \leqq A \leqq 3\ \text{mm}$.

FIG. 5A is a graph showing fluctuations in the contacting width in the range where 1 mm≦A≦3 mm, but 18°<θ.

As shown in FIG. 5A, under these conditions, the contacting width is consistently less than 2.6 mm, with a sufficient contacting width unable to be obtained. In this case, a state occurs that causes a transfer electric field to be generated in the small gap between the intermediate transfer belt and the transfer sheet directly before the transfer nip, and also causes toner spattering and pin points to occur easily. However, since degradation in the transfer image was not as evident as in the case of FIG. 4B, an evaluation of fair was given.

It is thought that when the entry angle θ exceeds 18° in this way, it becomes more difficult for the transfer sheet to go along the intermediate transfer belt, and therefore the contacting width is reduced.

Figure 5B:
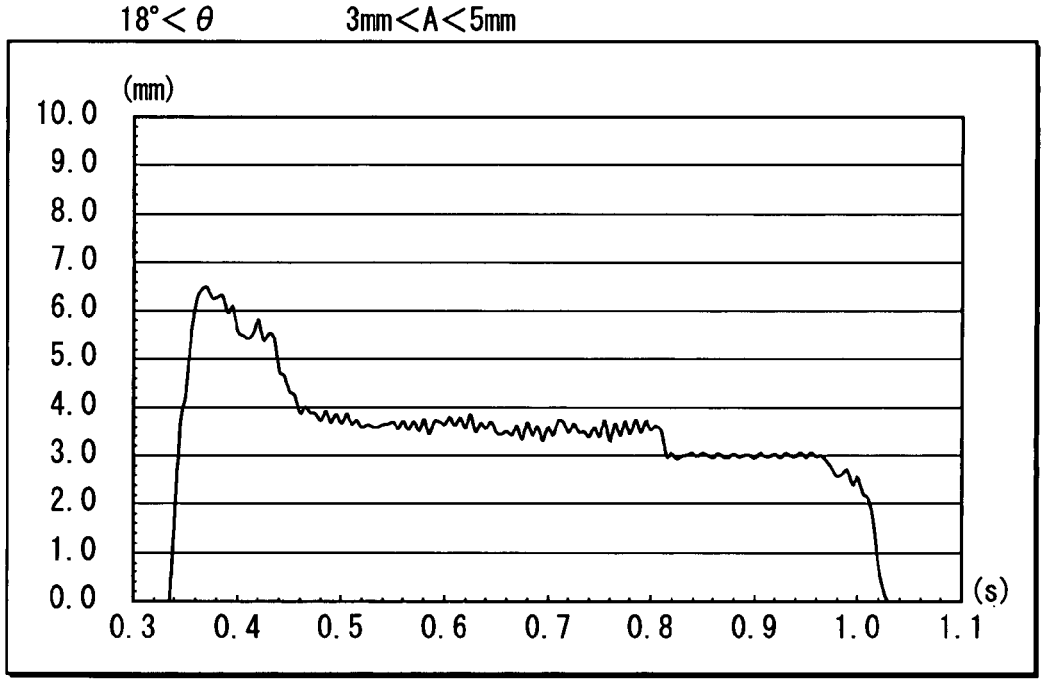
FIG. 5B is a graph showing fluctuations in the contacting width of the transfer sheet and the intermediate transfer belt in a range of $18° < \theta°$ and $3\ \text{mm} < A < 5\ \text{mm}$.

FIG. 5B is a graph showing fluctuations in the contacting width in the range 3mm<A<5 mm and 18°<θ.

In this case, since both the distance A and the entry angle θ exceed the optimum range, parts existing where the contacting width decreases dramatically as in FIG. 4B, while the contacting width is slightly smaller than in FIG. 4B.

Note that although no graph of when the entry angle θ is less than 13° is shown in the drawings, FIG. 3 shows that in this case when the distance A was 2 mm or less, an evaluation of fair was given as the contacting width is relatively small as in FIG. 5A. Furthermore, when the distance A exceeded 3 mm, an evaluation of poor was given due to the contacting width dramatically decreasing in parts as in FIG. 4B.

Furthermore, no data was taken for the case of A having a value of less than 1 mm because if the guide surface tip is brought any closer than this to the outer surface of the intermediate transfer belt 110, the pre-transfer guide 221 itself touches the intermediate transfer belt 110.

It was ascertained from the test data that the entry angle θ and the distance A are crucial parameters for maintaining favorable contacting width before the transfer nip and obtaining a favorable transfer image, and that to achieve this the conditions of 13°≦θ≦17° and 1 mm≦A≦3 mm must be met (hereinafter referred to as the optimum guide conditions).

Relationship with Other Parameters (1) Relationship with Process Speed

Since the optimum guide conditions were found using a process speed of 310 mm/s, test similar to those described above were also then carried out with different process speeds.

Note that except for the process speed, the conditions for these tests were the same as for the evaluation tests of FIG. 3.

First, a test was carried out with the process speed set at 256 mm/s, which is the process speed employed in an actual printer. The results were approximately the same as in the table in FIG. 3. Furthermore, similar evaluation tests with the process speed this time reduced to 60 mm/s obtained the results shown in the evaluation table of FIG. 6.

As can be seen from the evaluation table of FIG. 6, an evaluation of "good" was obtained in the range of 13°≦θ≦18° and 1 mm≦A≦3 mm, meaning that the optimum range with respect to the entry angle θ and the distance A is greater than in the case shown in FIG. 3. This is thought to be because the slower process speed reduces the impact when the transfer sheet enters the intermediate transfer belt 110.

Figure 7:
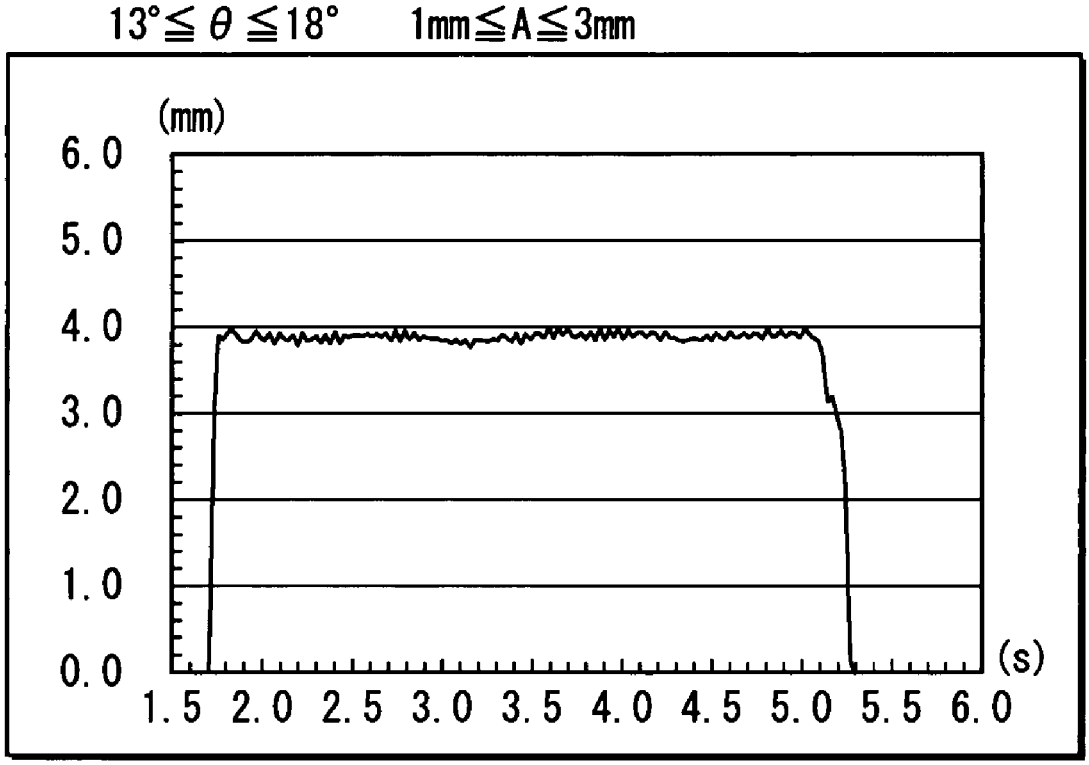
FIG. 7 is a graph showing fluctuations in the contacting width of the transfer sheet and the intermediate transfer belt in a range of $13° \leqq \theta° \leqq 18°$ and $1\ \text{mm} \leqq A \leqq 3\ \text{mm}$ in the evaluation tests of FIG. 6.

FIG. 7 is an example of a graph-showing test results in this case. The contacting width is stable within a range close to 4 mm, and therefore an extremely favorable transfer image was obtained. It can be assumed from this that the optimum range for the pre-transfer guide can be increased if the process speed is reduced.

Consequently, it is thought that the described optimum guide conditions are appropriate at least when the process speed is 310 mm/s or lower.

This processing speed of 310 mm/s belongs to the fastest class of technological level of current office-use image forming apparatuses. Even if an apparatus with a faster processing speed was developed, a favorable transfer image would be able to be obtained, at least in comparison with a secondary pre-transfer guide structure in a conventional image forming apparatus if the optimum guide conditions of the present condition are met.

(2) Relationship with Transfer Sheet Thickness

The optimum guide conditions found according to the evaluation tests of FIG. 3 were found using an ordinary transfer sheet (sheet basis weight 80 g/m$^2$), and therefore similar tests to those in FIG. 3 were carried out with different transfer sheet thicknesses.

Note that is these tests, the entry angle θ was set at 15° and the distance A was set at 1.5 mm. Other conditions were the same as in the tests in FIG. 3.

Figure 8A:
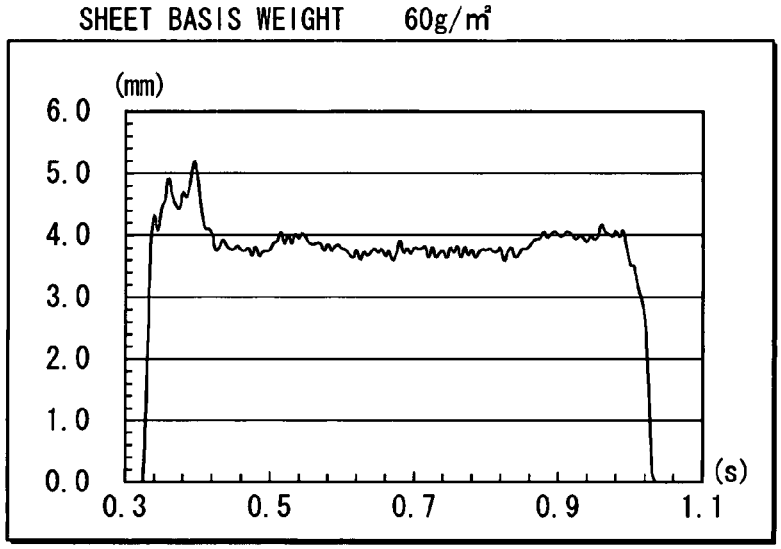
FIGS. 8A, 8B and 8C are graphs showing fluctuations in contacting width of the transfer sheet and the intermediate transfer belt for transfer sheet basis weight 60 g/m$^2$, 80 g/m$^2$, and 256 g/m$^2$, respectively, under conditions of $\theta=15°$ and $A=1.5$ mm.
Figure 8B:
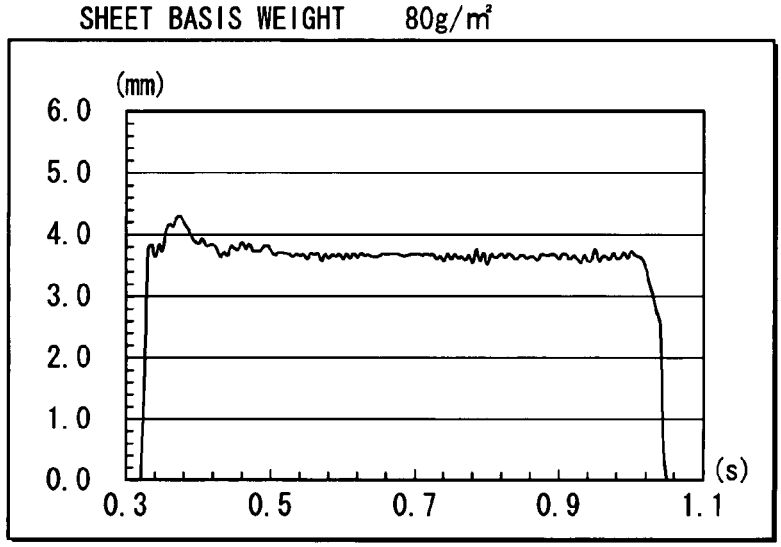
Figure 8C:
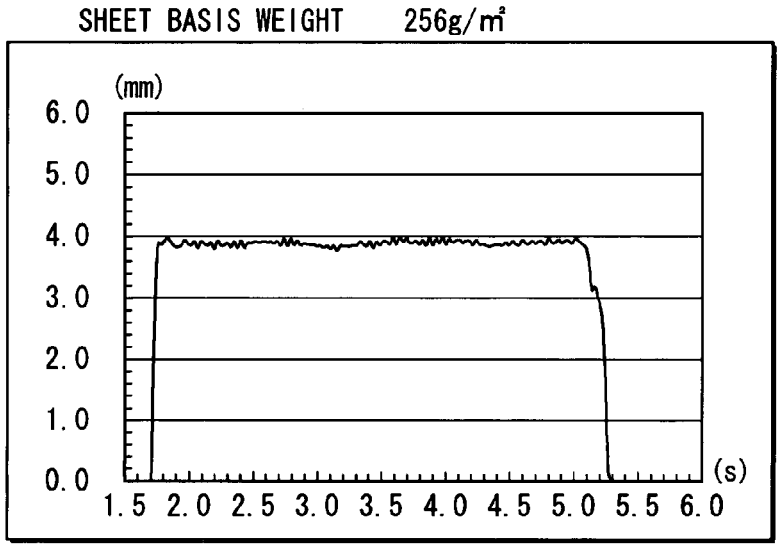

FIGS. 8A, 8B and 8C shows measurement results for respective cases of a sheet basis weight of 60 g/m$^2$, 80 g/m$^2$, and 256 g/m$^2$.

As shown in FIG. 8A, at 60 g/m$^2$, although the contacting width fluctuated by approximately 1 mm when the first thin transfer sheet entered, the contacting width was stable thereafter. As described above, almost no degradation occurs in the transfer image when the extent of fluctuation in the contacting with is approximately 1 mm.

Furthermore, in the cases of the sheet basis weight of 80 g/m$^2$and 256 g/m$^2$, the contacting width was stable at just under 4 mm as shown in FIG. 8B and FIG. 8C.

Approximately the same results were also obtained when the entry angle E and the distance A were varied within the range of the optimum guide conditions. Accordingly, it can be seen that the optimum guide conditions are appropriate in the range transfer sheet thicknesses in normal usage.

(3) Relationship with Curl of Transfer Sheet

The evaluation tests of FIG. 3 were carried out using a transfer sheet without curl. However, transfer sheets are subject to curling in either direction when they absorbs moisture as a result of being left in the air for some length of time, or conversely, when the moisture in the sheet evaporates due to the heat fixing of a first surface in double-sided printing. When the transfer sheet has curled, there is a possibility that the transfer sheet will not enter the intermediate transfer belt 110 at the angle defined by the guide surface of the pre-transfer belt 221.

In the present embodiment, however, the optimum guide conditions can be applied because the pre-transfer guide 222 provided facing the pre-transfer guide 221 corrects the curl, so that the transfer sheet is guided by the pre-transfer guide 221 in the direction of the intermediate transfer belt 110.

In the present example, the pre-transfer guide 221 that defines the actual entry angle extends further toward the intermediate transfer belt than the pre-transfer guide 222 does, and the curled sheet is sent forward while being corrected by being pushed against the guide surface side of the transfer guide 221 at the tip part of the pre-transfer guide 222. In the present embodiment, the shortest distance F between the tip part of the pre-transfer guide 222 and the guide surface of the transfer guide 221 is set at 0.7 mm to 1.0 mm. This is because a distance of any less than 0.7 mm will make it difficult for a thick transfer sheet to pass through, while a distance of any more than 1.0 mm reduces the effectiveness of curl correction and in some cases prevents the contacting width from stabilizing even under the optimum guide conditions.

Furthermore, an angle a between the guide surface of the pre-transfer guide 221 and the inner surface of the pre-transfer guide 222 is preferably 5.8° to 17.8°. With angle a set as such, curl can be corrected smoothly without the carrying speed of the transfer sheet being affected.

In fact, the contacting width was stable within the range of the optimum guide conditions and a favorable transfer image was obtained when tests similar to those in FIG. 3 were carried out with the described structure of the pre-transfer guide 222 to feed transfer sheets curled with respect to the pre-transfer guide 221 (a correct curl) and transfer sheets in an opposite state (a reverse curl), where the curvature radius R of the curl was 100 mm per length of 100 mm.

(4) Relationship with the Distance Between the Central Part of the Transfer Nip and the Guide Surface Tip In the tests in FIG. 3, the distance D between the central part of the transfer nip and the guide surface tip (hereinafter called the nip-guide distance) was set at 15.5 mm.

While it would seem likely that if the optimum guide conditions were met, the transfer sheet would be carried to the transfer nip stably once it has contacted the intermediate transfer belt, and little fluctuation would occur in the contacting width, tests such as those in FIG. 3 were carried out with an increased nip-guide distance D to confirm this.

While no problems were evident up to a nip-guide distance D of 18.5 mm, it was found that the contacting width fluctuated greatly when the nip-guide distance D was increased to 21.5 mm, regardless of the optimum guide conditions being met.

While the cause of this not clear, it is thought that although the transfer sheet, when entering at a predetermined angle, does contact the intermediate transfer belt 110, a force works to cause the paper to try to escape in the opposite direction from the intermediate transfer belt 110 due to the stiffness of the paper. When the distance to the transfer nip is relatively long, the force that causes the paper to try to escape heightens before the transfer sheet is clamped at the transfer nip, thus making the contacting width unstable.

Consequently, the optimum guide conditions are applicable as long as the nip-guide distance D is 18.5 mm or less.

On the other hand, the preferable minimum value for the nip-guide distance D is 13.3 mm. If the nip-guide distance D is any smaller, there is a risk that the transfer sheet guided by the pre-transfer guide 221 will directly enter the transfer nip, and the contacting width will be unable to be stabilized.

(5) Relationship with Secondary Transfer Voltage

Since toner spattering and pinholes are caused by the secondary transfer electric field, evaluation tests were carried out with different secondary transfer voltages.

In these tests, the secondary transfer voltage was varied by ±400V and ±200 of a reference voltage 1500V, which is a normally used secondary transfer voltage. Other conditions were the same as in the tests in FIG. 3. The contacting width was stable for each of the secondary transfer voltages. This shows that the size of the secondary transfer voltage is relatively insignificant in terms of conditions for stabilizing the contacting width, and that the optimum guide conditions are appropriate at least for normal usage.

(6) Relationship with Diameter of Secondary Transfer Roller

The diameter of the secondary transfer roller used in the tests of FIG. 3 was 29.6 mm. It could be assumed that if this diameter was excessively large, and hence the curvature rate was relatively small, the distance between the transfer sheet surface and the secondary roller front surface directly before the transfer nip N would decrease, thus causing an impediment to forming a favorable transfer image.

However, it is thought that if the diameter of the secondary transfer roller is made larger, the width of the transfer nip will be larger, and therefore the distance between the surface of the intermediate transfer belt 110 and the surface of the secondary transfer roller in the part directly before the transfer nip is not greatly affected by the size of the diameter of the secondary transfer roller.

Indeed, tests were carried out varying the diameter of the secondary transfer roller 131 within a range of 24.5 mm to 29.9 mm generally used in image forming apparatuses, but no effect was evident within the range of the optimum guide conditions.

Other (1) As described above, the positional relationship between the pre-transfer guides 221 and 222 and the intermediate transfer belt 110 is crucial in the present invention. Therefore, providing a positioning structure such as shown in the schematic drawing of FIG. 9 enables the pre-transfer guides 221 and 222 and the intermediate transfer belt 110 to be easily positioned when assembling the image forming apparatus, and also prevents the pre-transfer guides 221 and 222 and the intermediate transfer belt 110 from becoming out of alignment even if the image forming apparatus is in use for a long period of time. This maintains the optimum guide conditions.

Figure 9:
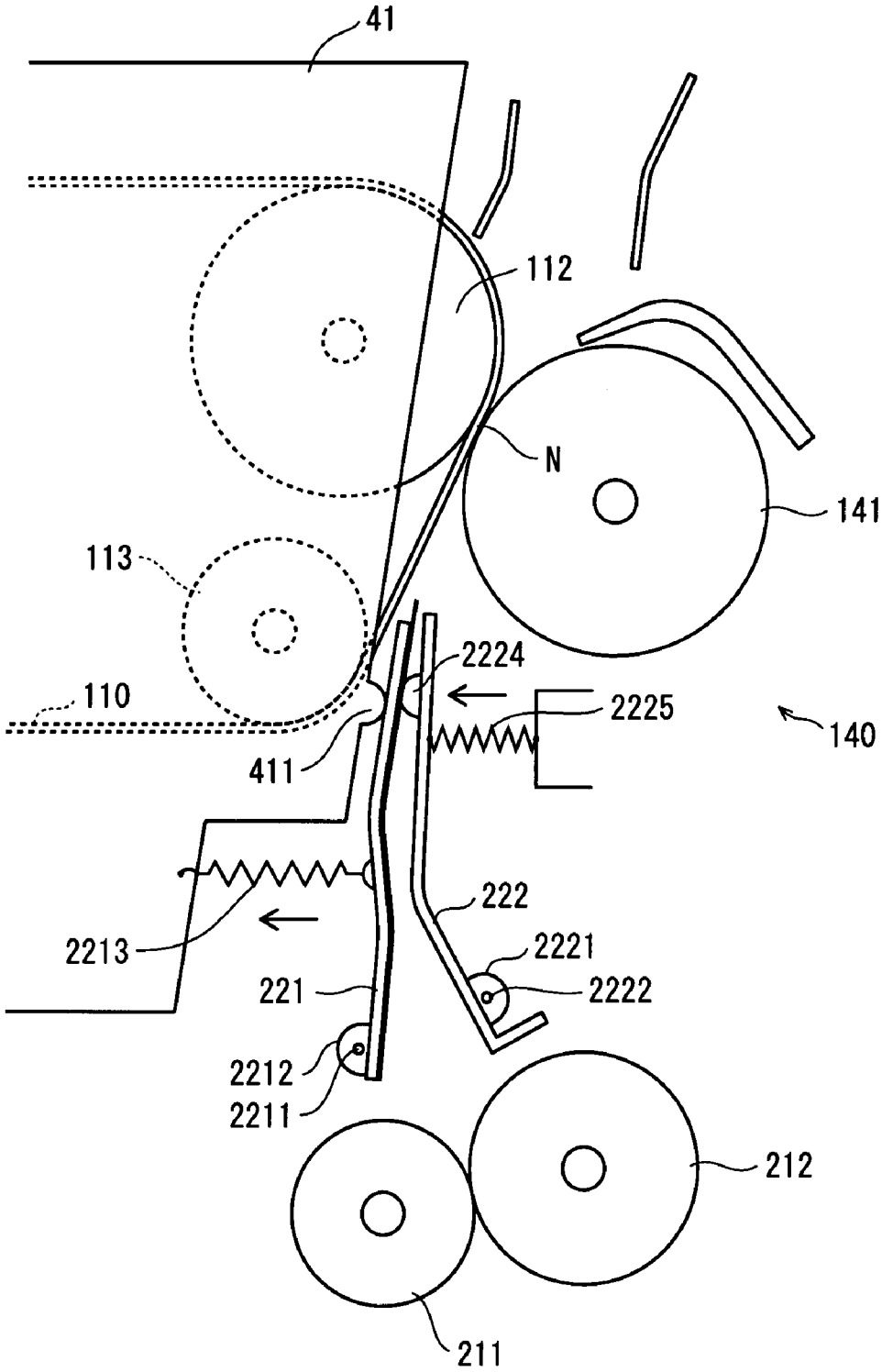
FIG. 9 is for describing relative positioning between an intermediate transfer belt 110, and pre-transfer guides 221 and 222.

More specifically, as shown in FIG. 9, bearings 2212 and 2221 are provided on the pre-transfer guides 221 and 222. The pre-transfer guides 221 and 222 are pivotally supported to be swingable, by a frame (not illustrated) via spindles 2211 and 2222, and are forced toward the intermediate transfer belt 110 by a tension spring 2213 and a compression spring 2225, respectively.

Of a frame 41 that supports the driving roller 112 and the auxiliary roller 113, the portion that contacts the pre-transfer guide 221 has a positioning protrusion 411, and is structured such that in a state in which the pre-transfer guide 221 contacts the positioning protrusion 411, the tip part of the guide surface is an appropriate distance from the pre-transfer belt 110. The appropriate distance is between 1 mm and 3 mm, for instance 2 mm.

Furthermore, a positioning protrusion 2224 is also provided on the pre-transfer guide 222. The positioning protrusion 2224 is set so as to contact the pre-transfer guide 221, with the interval between the tip of the positioning protrusion 2224 and the pre-transfer guide 221 being 0.7 mm to 1.0 mm.

Although the positioning protrusions 411 and 2224 are provided only at the near side of the passing transfer sheet in FIG. 9, it is of course preferable that positioning protrusions are also provided at the far side of the passing transfer sheet. In particular, protrusions 2224 are provided at both ends of the pre-transfer guide 222 in a manner that does not affect the transfer sheet passing through. Furthermore, one or both of positioning protrusions 411 and 2224 may be provided on the pre-transfer guide 221 side.

The means for forcing the pre-transfer guides 221 and 222 towards the intermediate transfer belt 110 are not limited to a tension spring and a compression spring, but may, for example, be a flat spring. Alternatively, the pre-transfer guides 221 and 222 may be made of a material having an appropriate elasticity, and arranged so that they themselves fall towards the intermediate transfer belt 110. This enables positioning to be achieved by the protrusions 411 and 2224 touching the pre-transfer guide 221 according to their own elasticity.

(2) In the preferred embodiment, the transfer sheet advances along the pre-transfer guide 221. However, the positions of the timing rollers 211 and 212 may be changed to an extent, with the tangent plane in the nip thereof tilted toward the pre-transfer guide 222, and a transfer sheet sent by this arrangement may advance along the pre-transfer guide 222. In this case, the optimum guide conditions are applied to the pre-transfer guide 222.

(3) Although the preferred embodiment describes an example of the present invention being applied to a tandem color printer, the present invention may be applied to any kind of image forming apparatus, such as a color copier, a monochrome printer, a monochrome copier, a facsimile apparatus or an MFP (Multiple Function Peripheral), that employs a method of transferring a toner image from a belt-shaped image holding body (image holding belt) to a transfer sheet.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus, comprising:

an image holding belt which is suspended about a plurality of rollers including a first roller and a second roller, and circulates in a predetermined direction;

an image forming unit operable to form a toner image on a surface of the image holding belt;

a transfer roller that contacts a portion of the circulating image holding belt, which is supported by the first roller, thereby forming a transfer nip, a transfer electric field being generated between the transfer roller and the first roller, and the toner image being transferred from the surface of the image holding belt to a transfer sheet that passes through the transfer nip;

a first guide member operable to guide the transfer sheet to a flat portion of the circulating image holding belt surface, the flat portion being located upstream from the transfer nip in a circulation direction of the image holding belt and between the first and second rollers, a first forcing mechanism operable to force the first guide member toward the image holding belt;

a first regulating member that contacts the first guide member, and is operable to regulate a distance from the first guide member to the surface of the image holding belt;

a second guide member positioned so as to oppose the first guide member, the transfer sheet passing between the first guide member and the second guide member;

a second forcing mechanism operable to force the second guide member toward the first guide member; and a second regulating member operable to regulate a distance between opposing surfaces of the first guide member and the second guide member;

wherein an angle formed by a guide surface of the first guide member and a surface of the flat portion of the image holding belt is no less than 13° and no greater than 17°, and a distance between a closest edge of the guide surface to the image holding belt and the surface of the image holding belt is no less than 1.0 mm and no greater than 3.0 mm.

2. The image forming apparatus of claim 1, wherein a distance from (a) a central position of the transfer nip in the circulation direction of the image holding belt to (b) the closest edge of the guide surface to the image holding belt is no less than 13.3 mm and no greater than 18.5 mm.

3. The image forming apparatus of claim 1, wherein the second regulating member regulates the distance between the opposing surfaces of the first guide member and the second guide member as to be no less than 0.7 mm and no greater than 1.0 mm at a location closest to the transfer nip.

* * * * *